US006715256B1

(12) United States Patent
Fischer

(10) Patent No.: US 6,715,256 B1
(45) Date of Patent: Apr. 6, 2004

(54) SLIDING HOLD-DOWN CLIP FOR STANDING SEAM METAL ROOF

(75) Inventor: Keith Fischer, Eufaula, AL (US)

(73) Assignee: Magnatrax Corporation, Eufala, AL (US)

( * ) Notice: Subject to any disclaimer, the term of this patent is extended or adjusted under 35 U.S.C. 154(b) by 0 days.

(21) Appl. No.: 10/113,541

(22) Filed: Mar. 29, 2002

(51) Int. Cl.[7] ..... E04B 1/38; E04B 2/00; E04D 1/34; E04D 1/00

(52) U.S. Cl. ..... 52/713; 52/545; 52/546; 52/537; 52/538; 52/582.1

(58) Field of Search ..... 52/713, 715, 529, 52/530, 537, 538, 545, 546, 588.1, 582.1, 543, 547, 698, 528

(56) References Cited

U.S. PATENT DOCUMENTS

| | | | | | |
|---|---|---|---|---|---|
| 3,111,788 | A | * | 11/1963 | Ouellet | 52/537 |
| 3,606,720 | A | * | 9/1971 | Cookson | 52/714 |
| 3,640,043 | A | * | 2/1972 | Querfeld et al. | 52/508 |
| 3,998,019 | A | * | 12/1976 | Reinwall, Jr. | 52/478 |
| 4,034,532 | A | * | 7/1977 | Reinwall, Jr. | 52/520 |
| 4,133,161 | A | * | 1/1979 | Lester | 52/748.1 |
| 4,296,581 | A | * | 10/1981 | Heckelsberg | 52/520 |
| 4,400,922 | A | * | 8/1983 | Boyer | 52/394 |
| 4,514,952 | A | * | 5/1985 | Johansson | 52/713 |
| 4,543,760 | A | * | 10/1985 | Barker et al. | 52/544 |
| 4,575,983 | A | | 3/1986 | Lott, Jr. et al. | |
| 4,796,403 | A | * | 1/1989 | Fulton et al. | 52/713 |
| 5,001,882 | A | * | 3/1991 | Watkins et al. | 52/547 |
| 5,181,360 | A | | 1/1993 | Shingler | |
| 5,187,911 | A | * | 2/1993 | Cotter | 52/469 |
| 5,222,341 | A | | 6/1993 | Watkins et al. | |
| 5,715,640 | A | * | 2/1998 | Haddock | 52/545 |
| 5,743,063 | A | | 4/1998 | Boozer | |
| 5,867,959 | A | * | 2/1999 | Ruble | 52/545 |

* cited by examiner

*Primary Examiner*—Brian E. Glessner
*Assistant Examiner*—Kevin McDermott
(74) *Attorney, Agent, or Firm*—Needle & Rosenberg, P.C.

(57) ABSTRACT

A sliding hold-down clip (1) for connecting a roof panel (52) to a purlin (52) in which a support portion (14) extends from a base (12), the support portion defining a slot (20) with fasteners (34) that connect to a roof-engaging plate (36), the fasteners guiding longitudinal movement of the roof-engaging plate (36) along the slot relative to the clip, a distal end of the plate defining a hook (40) for connecting to edges of adjacent roof panels (52), a pair of opposing wings (46, 48) extending laterally from the roof-engaging plate (36) and angled to conform to an anglation of a side portion of the roof panel, whereby fasteners (58) extending though the roof panel and the wings secure the roof panel to the roof-engaging plate. A method of securing roof panels to purlins is disclosed.

14 Claims, 2 Drawing Sheets

SLIDING HOLD-DOWN CLIP FOR STANDING SEAM METAL ROOF

TECHNICAL FIELD

The present invention relates hold-down clips for connecting standing seam metal roof panels. More particularly, the present invention relates to a sliding hold-down clip providing structural integrity of the seam connecting adjacent standing seam roof panels in buildings.

BACKGROUND OF THE INVENTION

Large bay structures, such as warehouses, commercial, institutional, and industrial typically have large areas of floor surface, with spaced-apart support columns, and high roofs. The support columns connect to long span roof supports, known as purlins. Large roof panels, typically made of metal sheeting or panels, sit on the purlins, as cladding to enclose the structure. Adjacent roof panels interlock together at edges to form seams. This is accomplished by mechanically seaming the panels together, such as by folding and crimping edges portions to form standing seams, or by snapping interlocks together.

The seam is formed above the plane of the roof to prevent leakage. Slidable hold-down clips connect spaced apart relation to the purlins. The hold-down clips have hook-like projecting members that receive edges of the opposing roof panels. In some known roof systems, the hook-like projecting members foldingly engage and crimp with the roof members to secure the roof members to the purlins. In other systems, the adjacent opposing roof panels define matingly engagable connections. The hold-down clips however have slidable portions that connect with the hook-like projecting members to the roof panels. The sliding capablity allows the roof connections to accommodate expansion and contraction of the roof formed by the interconnected roof panels. Accordingly, the roof "floats" on the purlins or other support structures.

In addition, wind loads on the roof can become significant, particularly near corners and eaves portions. For traditional "screw down" roofs attached to the purlins with fasteners that penetrate the roof panels in the plane of the roof, this wind load and the expansion and contraction of the roof panel can elongate the hole around the fastener. The elongation can lead to leakage. Accordingly, a sufficient number of hold-down clips must be used to securely hold the roof panels in the large bay structures. Installation of hold-down clips is a laborious and time consuming task. Further, to meet loading requirements, the thickness of the roof panel must be increased or the span of the roof panel must be decreased by additional purlins. Either increases the costs associated with metal roofs.

Accordingly there is a need in the art for providing improved sliding hold-down clips for connecting roof panels to purlins in large bay buildings. It is to such that the present invention is directed.

BRIEF SUMMARY OF THE INVENTION

The present invention meets the need in the art by providing a sliding hold-down clip for connecting a standing seam roofing panel to a purlin in which the clip has a base that defines openings for receiving fasteners to secure the clip to the purlin. A support portion extends from the base and defines a slot. Fasteners extend through the slot and connect to a roof-engaging plate with the fasteners guiding longitudinal movement of the roof-engaging plate along the slot relative to the clip. A distal end of the roof-engaging plate defines a tab for connecting to a crimped edge of a roof, the improvement comprising a pan engaged to the roof-engaging plate and having at least two opposing wing portions extending therefrom, the wing portions for bearing against respective roofing panels and receiving a fastener through the roofing panel and the wing portion to secure the wing portion to the roofing panel.

In another aspect, the present invention provides a sliding hold-down clip for connecting a roof panel to a purlin in which the clip has a base that defines openings for receiving fasteners to secure the clip to the purlin, the clip defining a slot in a support portion extending from the base, a roof-engaging plate connected by fasteners through the slot for guiding longitudinal movement of the roof-engaging plate along the slot relative to the clip, a distal end of the plate defining a hook for connecting to edges of adjacent roof panels, a pair of opposing wings extending laterally from the roof-engaging plate and angled to conform to an anglation of a side portion of the roof panel, whereby fasteners extending though the roof panel and the wings secures the roof panel to the roof-engaging plate.

In another aspect, the present invention provides a method for connecting roof panels to purlins with a sliding hold-down clip, comprising the steps of:

(a) securing sliding hold-down clips in a spaced-apart relation to a purlin, each of the sliding hold-down clips having a base that defines openings for receiving fasteners to secure the clip to the purlin, the clip defining a slot in a support portion extending from the base, a roof-engaging plate connected by fasteners through the slot for guiding longitudinal movement of the roof-engaging plate along the slot relative to the clip, a distal end of the plate defining a hook for connecting to edges of adjacent roof panels, and a pair of opposing wings extending laterally from the roof-engaging plate and angled to conform to an anglation of a side portion of the roof panel;

(b) installing at least one roof panel on the purlin adjacent the hold-down clip to partially cover a space; and (c) placing fasteners through the roof panel and one of the wings covered by the roof panel, whereby the fasteners extending though the roof panel and the wing secures the roof panel to the roof-engaging plate.

Objects, advantages and features of the present invention will become apparent from a reading of the following detailed description of the invention and claims in view of the appended drawings.

DETAILED DESCRIPTION OF THE PREFERRED EMBODIMENT

Figure 1:
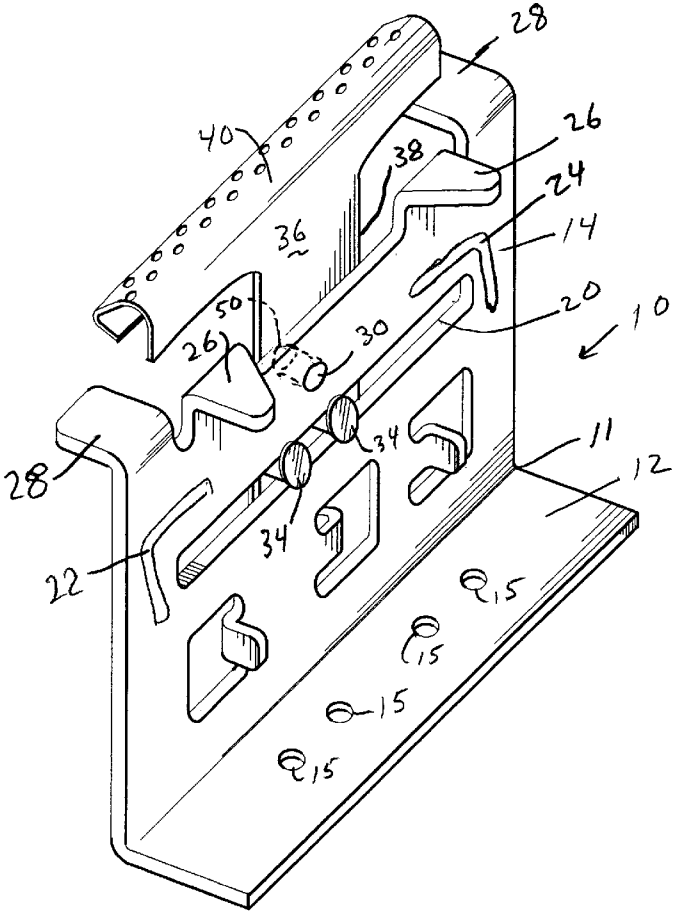
FIG. 1 illustrates a perspective view of a sliding hold-down clip for securing standing seam roof panels to purlins in large bay buildings.

Referring now in more detail to the drawings, in which like numerals indicate like parts throughout the several views, FIG. 1 illustrates in perspective view a sliding hold-down clip 10 for securing standing seam roof panels to purlins in large bay buildings. The clip 10 is an angle member 11 that includes a base 12 and a support portion 14 extending at an angle relative to the base. In the illustrated embodiment, the base 12 and support portion 14 are perpendicular. The base 12 defines at least several openings 15 for receiving fasteners to connect the clip 10 to a support such as a purlin in a large bay structure, as discussed below. The support portion 14 further defines a slot 20 extending substantially the length of the clip 10. A pair of stiffening ribs 22, 24 are formed in the support portion 14 offset from respective opposing ends of the slot 20. Two pairs of opposing tabs 26, 28 extend laterally from an upper edge of the support portion 14. The support portion 14 defines an opening 30 in a distal portion. The opening receives a detachable pin 32 (best illustrated in the cut-away view in FIG. 2.)

A pair of fasteners 34 extend through the slot 20 and connect to a roof engaging plate 36. The head of the fastener is larger than the width of the slot 20. In the illustrated embodiment, the fasteners 34 are rivets. The fasteners 34 guide the longitudinal movement of the roof engaging plate 36 relative to the slot 20, as discussed below. The roof engaging plate 36 includes a sliding portion 38 and a hook portion 40 at a distal end of the roof-engaging plate 36. The hook portion 40 opens generally in a direction towards the base 12 of the clip 10.

Figure 2:
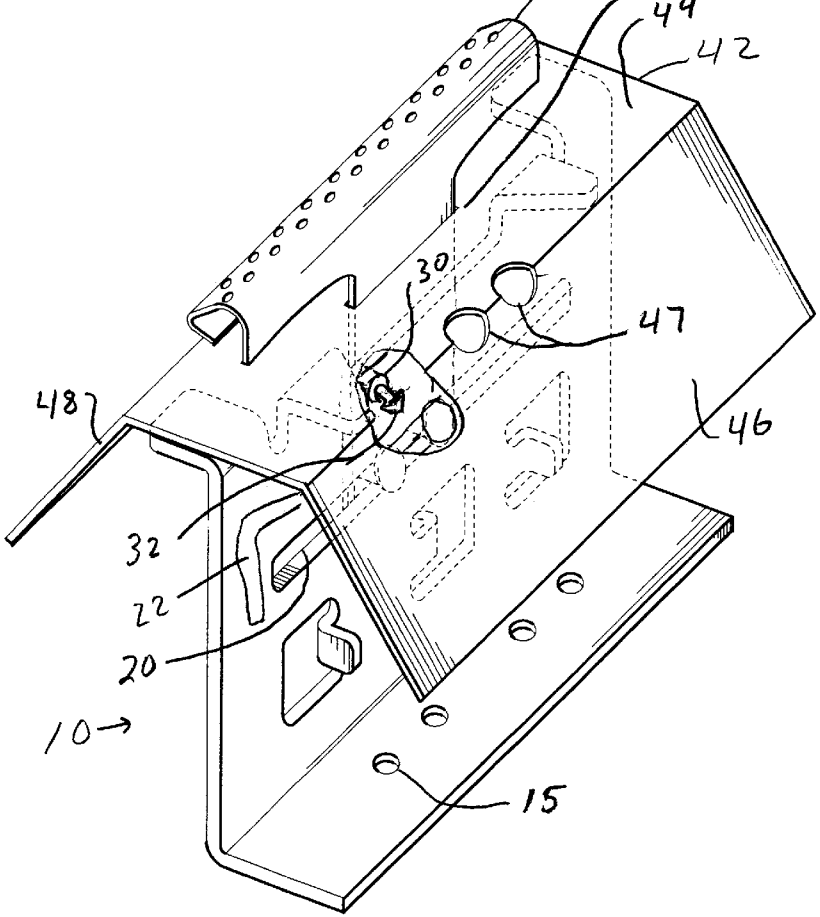
FIG. 2 illustrates a perspective partially cut-away view of a sliding hold-down clip according to the present invention for securing standing seam roof panels to purlins in large bay buildings.

With reference to FIG. 2, the clip 10 according to the present invention includes a tent-like pan 42 with a central portion 44 from which opposing wing portions 46, 48 extend laterally. The central portion 44 in the illustrated embodiment defines a slot 49 substantially central to the pan 42. The pan 42 also defines a pair of holes 47, which in the illustrated embodiment, are positioned towards the slot 46. The sliding portion 38 of the roof engaging plate 36 passes through the slot 49. The sliding portion 38 defines a hole 50 (see FIG. 1) that aligns with the opening 30. The detachable pin 32 pass through the aligned opening 30 and hole 50 to secure the roof engaging plate 38 to the support portion 14. The detachable pin 32 centers the roof engaging plate 36 medial the opposing ends of the slot 20 for installation and connection of the clip between a purlin and seamed roof panels as discussed below.

Figure 3:
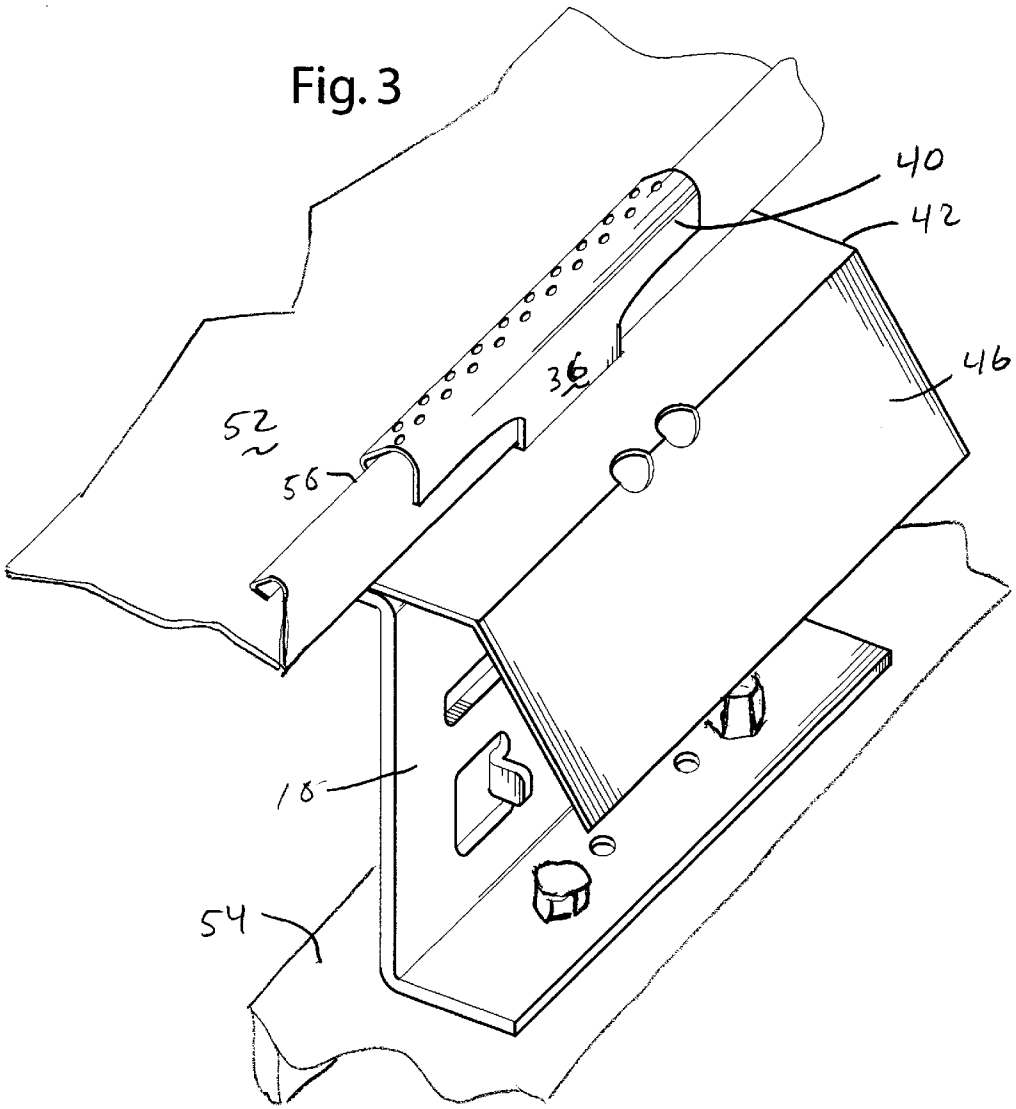
FIG. 3 illustrates a detailed perspective view of a portion of a standing seam roof panel connected by the sliding hold-down clip illustrated in FIG. 1 to a purlin.

FIG. 3 illustrates a detailed perspective view of a portion of a standing seam roof panel 52 connected by the sliding hold-down clip 10 illustrated in FIG. 1 to a purlin 54. The hook portion 40 on the roof-engaging plate receives an edge 56 of the roof panel 52.

Figure 4:
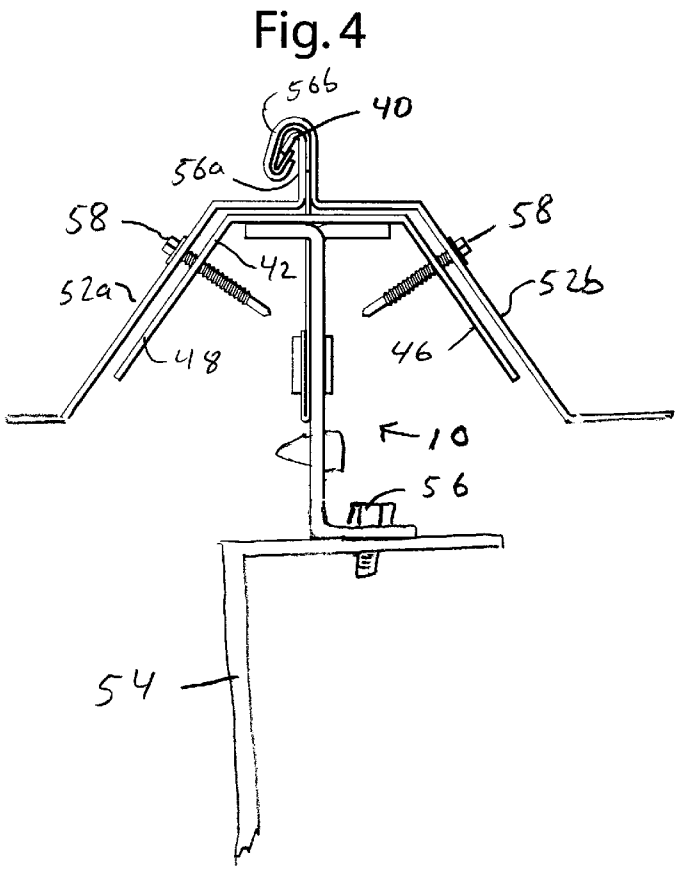
FIG. 4 illustrates a detailed end view of the sliding hold-down clip connecting standing seam roof panels to a purlin.

FIG. 4 is a detailed end view of the sliding hold-down clip 10 connecting a pair of opposing standing seam roof panels 52*a*, 52*b* to the purlin 54. Fasteners 56 extend through the openings 15 in the base 12 and a portion of the purlin 54. The fasteners 56 are preferably self-tapping screws. The hook portion 40 receives the respective side edges of the edge portions 56*a*, 56*b* of the roof panels 52*a*, 52*b*. As illustrated, the hook portion 40 folds over together with the edge portions 56*a*, 56*b* to crimp the hook portion and the edge portions together securely. Fasteners 58, such as self-tapping screws, extend through the edge portions and the wing portions 46, 48 to secure the pan 42 to the opposing roof panels 52*a*, 52*b*, and thereby further connect the roof panels to the clip 10.

With reference to FIGS. 1 and 2, the angle member 11 is preferably formed from 12 gauge galvanized steel sheet, 0.104 inch thick, ASTM A446 Grade D 50 KSI minimum strength, such as by stamping and folding. The roof-engaging plate 36 is preferably formed from AZ55 aluminum-zinc alloy coated metal sheet with a 0.031 inch thickness and 48 KSI minimum strength. The pan 42 is preferably formed from 16 gauge aluminum-zinc alloy coated or pre-painted steel sheet, ASTM A446 Grade D 50 KSI minimum strength. The wing portions 46, 48 are bent at an angle relative to the central portion 44 to conform substantially to the angle of the edge portion 56 of the roof panels 52. These can be varied to meet the reinforcement requirements of the particular roof installation.

The angle member 11 and the roof-engaging plate 14 assemble with the fasteners 34 extending through the slot 20 and connecting to the roof engaging plate 36. In the illustrated embodiment, the fasteners 34 are rivets with heads larger than the width of the slot 20. The hole 50 of the roof engaging plate 36 aligns with the opening 30 in the support portion 14. The detachable pin 32 passes through the hole 50 and the opening 30 to secure the roof engaging plate 36 preferably centrally relative to the slot 20.

With reference to FIGS. 3 and 4, the clip 10 attaches with the fasteners 56 to the purlin 54 such as is typically used as a roof support member in large bay buildings. The holes 47 permit a tool to access the base 12 for turning the fastener 56. The purlins then receive the roof panel 52*a*. The hook portion 40 of the clip 10 receives a side edge on the roof panel 52*a*. The pan 42 supports the edge portion 56 of the roof panel 52, with the wing portion 48 aligned with an angled portion. The wing provides surface area under the roof panel 52 for attachment of the fastener 58. One of the fasteners 58 extends through the roof panel 52*a* and the wing 48 to secure the roof panel to the roof-engaging plate 36. The attachment is above the plane of the roof defined by the roof panels, so as to reduce the potential for leakage. A tool such as clippers, knife, screwdriver, or like implement, may be used through one of the openings 47 to detach the pin 32. Alternatively, the detachable pin 32 is not removed during roof assembly. Rather, the expansion and contraction of the roof shears the pin 32. In an alternate installation, the clip 10 is first secured to a side tab or edge of the roof panel 52, and subsequently attached with the fasteners 56 to the purlin during construction at a job site.

The opposing adjacent roof panel 52*b* is positioned on the purlins. The hook portion 40 similarly receives the side edge of the opposing roof panel 52*b* with an angle portion supported by the wing 46. The hook portion 40 is folded towards the base 12 and crimped to secure the roof-engaging plate opposing roof panel 52. One of the fasteners 58 extends through the roof panel 52*b* and the wing 48 to secure the roof panel to the roof-engaging plate 36.

Other of the clips 10 are similarly connected between the purlins 54 and the opposing roof panels 52, in spaced-apart relation.

The roof panels 52 are subject to heating and cooling, and this causes the roof made of the panels to expand and contract. The roof-engaging plates 36 in the hold-down clips 10 move longitudinally in the slots 20 as the roof panels expand and contract. The fasteners 34 connecting the roof-engaging along the slots 20. The angle member 11 of the clip 10 secures the roof panels 52 to the purlins while allowing expansion and contraction movement. The pan 42 being engaged to the roof-engaging plate 36 likewise moves as the roof panels 52 expand and contract.

The present invention of the sliding hold-down clip 10 secured with the hook portion 40 and the fasteners 58 that connect the pan 42 and the roof panels 52 allow the spacing between clips 10 to be increased over prior known sliding hold-down clips. This reduces installation labor, time, and costs, while also provides a secure hold-down for large bay metal roof panels.

While this invention has been described in detail with particular reference to the preferred embodiments thereof, the principles and modes of operation of the present invention have been described in the foregoing specification. The invention is not to be construed as limited to the particular forms disclosed because these are regarded as illustrative rather than restrictive. Moreover, modifications, variations and changes may be made by those skilled in the art without departure from the spirit and scope of the invention as described by the following claims.

What is claimed is:

1. A sliding hold-down clip for connecting a roof panel to a purlin in which the clip has a base that defines openings for receiving fasteners to secure the clip to the purlin, the clip defining a slot in a support portion extending from the base, a roof-engaging plate connected by fasteners through the slot for guiding longitudinal movement of the roof-engaging plate along the slot relative to the clip, a distal end of the plate defining a hook for connecting to edges of adjacent roof panels, the improvement comprising a pan received on the roof-engaging plate between the hook and an upper edge of the support portion, the pan having a central portion and two opposing wing portions extending lateral of the central portion, the wing portions for bearing against respective roofing panels and receiving a fastener through the roof panels and the wing portion to secure the wing portion to the roof panels.

2. The improved clip as recited in claim 1, wherein the wing portions extend at an angle relative to the central portion, the angle conforming to an angle defined by the edge portion of the roof panel.

3. The improved clip as recited in claim 1, wherein herein the clip includes a detachable locking pin to secure the roof-engaging plate in a central intermediate portion of the slot, the detachable locking pin released after connection of the hook to a first one of the roofing panels, and wherein the pan further defines at least one hole in a lateral portion for passage of a tool to release the locking pin.

4. A clip for connecting a roof panel to a purlin, comprising:

an angle member defining a base and a support portion extending at an angle from the base, the base adapted for engaging to a purlin;

the support portion defining a slot therein;

a roof-engaging plate connected by fasteners extending through the slot, the fasteners guiding longitudinal movement of the roof-engaging plate along the slot relative to the support portion; and a pan engaged to the roof-engaging plate, the pan having a central portion and two opposing wing portions extending laterally of the central portion, the wing portions for bearing against respective roofing panels and receiving a fastener through the roofing panel and the wing portion to secure the wing portion to the roofing panel.

5. The clip as recited in claim 4, wherein the roof-engaging plate defines an extending distal end for connecting to an edge portion of a roofing panel.

6. The improved clip as recited in claim 4, wherein the wing portions extend at an angle relative to the central portion, the angle conforming to an angle defined by a side portion of the roof panel.

7. A sliding hold-down clip connected to a roof panel in which the clip has a base that defines openings for receiving fasteners to secure the clip to a purlin, the clip defining a slot in a support portion extending from the base, a roof-engaging plate connected by fasteners through the slot for guiding longitudinal movement of the roof-engaging plate along the slot relative to the clip, a distal end of the plate defining a hook for connecting to edges of adjacent roof panels, a pair of opposing wings extending laterally from the roof-engaging plate and angled to conform to an anglation of a side portion of the roof panel, whereby fasteners extending through the roof panel and the wings secures the roof panel to the roof-engaging plate.

8. The sliding hold-down clip as recited in claim 7, wherein the wings extend from a central portion of a pan received on the roof-engaging plate between the hook and an upper edge of the support portion.

9. A method for connecting roof panels to purlins with a sliding hold-down clip, comprising the steps of:

(a) securing sliding hold-down clips in a spaced-apart relation to a purlin, each of the sliding hold-down clips having a base that defines openings for receiving fasteners to secure the clip to the purlin, the clip defining a slot in a support portion extending from the base, a roof-engaging plate connected by fasteners through the slot for guiding longitudinal movement of the roof-engaging plate along the slot relative to the clip, a distal end of the plate defining a hook for connecting to edges of adjacent roof panels, and a pair of opposing wings extending laterally from the roof-engaging plate and angled to conform to an anglation of a side portion of the roof panel;

(b) installing at least one roof panel on the purlin to partially cover a space; and (c) placing fasteners through the roof panel and one of the wings covered by a portion of the roof panel, whereby the fasteners extending through the roof panel and the wing secures the roof panel to the roof-engaging plate.

10. A clip for connecting a roof panel to a purlin, comprising:

an angle member defining a base and a support portion extending at an angle from the base, the base adapted for engaging to a purlin;

the support portion defining a slot therein;

a roof-engaging plate slidingly engaged with the slot for guiding longitudinal movement of the roof-engaging plate along the slot relative to the support portion; and a pan engaged to the roof-engaging plate, the pan having a central portion and two opposing wing portions extending laterally of the central portion, the wing portions for bearing against respective roofing panels and receiving a fastener through the roofing panel and the wing portion to secure the wing portion to the roofing panel.

11. A method for connecting roof panels to purlins with a sliding hold-down clip, comprising the steps of:

(a) securing sliding hold-down clips in a spaced-apart relation to a purlin, each of the sliding hold-down clips having a base that defines openings for receiving fasteners to secure the clip to the purlin, the clip defining a slot in a support portion extending from the base, a roof-engaging plate slidingly engaged with the slot for guiding longitudinal movement of the roof-engaging plate along the slot relative to the clip, a distal end of the plate defining a hook for connecting to edges of adjacent roof panels, and a pair of opposing wings extending laterally from the roof-engaging plate and angled to conform to an anglation of a side portion of the roof panel;

(b) installing at least one roof panel on the purlin to partially cover a space; and (c) placing fasteners through the roof panel and one of the wings covered by a portion of the roof panel, whereby the fasteners extending through the roof panel and the wing secures the roof panel to the roof-engaging plate.

12. The improved clip as recited in claim 1, wherein the pan further comprises an area defining an aperture therethrough sized and shaped to receive at least a portion of the roof engaging plate.

13. The improved clip as recited in claim 4, wherein the pan further comprises an area defining an aperture therethrough sized and shaped to receive at least a portion of the roof engaging plate.

14. The improved clip as recited in claim 10, wherein the pan further comprises an area defining an aperture therethrough sized and shaped to receive at least a portion of the roof engaging plate.

* * * * *